US008413991B2

(12) United States Patent
Sudbeck et al.

(10) Patent No.: US 8,413,991 B2
(45) Date of Patent: Apr. 9, 2013

(54) MOVING TARGET FOR SHOOTING PRACTICE

(75) Inventors: Cory Lee Sudbeck, Fordyce, NE (US); Samuel John Goeden, Hartington, NE (US)

(73) Assignee: Flippin' Critters, LLC, Yankton, SD (US)

( * ) Notice: Subject to any disclaimer, the term of this patent is extended or adjusted under 35 U.S.C. 154(b) by 0 days.

(21) Appl. No.: 13/458,090

(22) Filed: Apr. 27, 2012

(65) Prior Publication Data

US 2012/0274028 A1 Nov. 1, 2012

Related U.S. Application Data

(60) Provisional application No. 61/480,504, filed on Apr. 29, 2011.

(51) Int. Cl.
*F41J 7/00* (2006.01)

(52) U.S. Cl.
USPC ..... 273/392; 273/406

(58) Field of Classification Search ..... 273/390–392, 273/403–410
See application file for complete search history.

(56) References Cited

U.S. PATENT DOCUMENTS

| | | | | | |
|---|---|---|---|---|---|
| 157,335 | A * | 12/1874 | Lyon | 273/388 |
| 1,424,632 | A * | 8/1922 | Fenton | 273/392 |
| 2,456,964 | A * | 12/1948 | Ledure | 211/33 |
| 2,967,712 | A * | 1/1961 | Breitenfeldt | 273/388 |
| 3,635,476 | A * | 1/1972 | Breslow et al. | 273/390 |
| 4,283,060 | A * | 8/1981 | Braunschweiler | 273/383 |
| 4,503,101 | A * | 3/1985 | Bennett | 428/9 |
| 5,209,492 | A | 5/1993 | Hamilton | |
| 6,896,267 | B1 * | 5/2005 | Le Anna | 273/391 |
| 6,991,233 | B2 | 1/2006 | Goldsmith, Jr. | |
| 6,994,348 | B2 | 2/2006 | Lambert et al. | |
| 7,114,725 | B2 * | 10/2006 | Camp et al. | 273/390 |
| 7,134,977 | B2 * | 11/2006 | Campbell et al. | 473/454 |
| 7,175,181 | B1 * | 2/2007 | Bateman et al. | 273/392 |
| 7,766,338 | B1 * | 8/2010 | Adler et al. | 273/407 |
| 7,815,192 | B1 * | 10/2010 | Kreiman et al. | 273/390 |
| 2008/0054570 | A1 | 3/2008 | Potterfield et al. | |
| 2008/0272548 | A1 | 11/2008 | Hensley | |
| 2009/0315265 | A1 | 12/2009 | Ball | |
| 2011/0062668 | A1 * | 3/2011 | Leimberer | 273/407 |
| 2011/0163504 | A1 * | 7/2011 | Berger et al. | 273/386 |

* cited by examiner

*Primary Examiner* — Mark Graham
(74) *Attorney, Agent, or Firm* — Etherton Law Group, LLC; Sandra L. Etherton

(57) ABSTRACT

Four paddles emanate from a central point that is substantially equidistant from the end of each of the four paddles. Three of the paddles are configured to be positioned on the ground at any one time in a three-point stance, causing the fourth paddle to be upright and perpendicular to the ground. The upright paddle serves as the target. When a shot hits the device above its center of gravity, the device flips, thus moving away from the shooter. Thus, the device automatically resets itself and moves to a new location, ready for the next hit. Preferably, each paddle is planar from near the central point to the paddle's distal end. Preferably each paddle also has a direction indicator. In a preferred embodiment, each paddle is about 5.5" long and the target is made of AR400 steel for practice with a 0.22 caliber bullet.

2 Claims, 11 Drawing Sheets

MOVING TARGET FOR SHOOTING PRACTICE

CROSS-REFERENCE TO RELATED APPLICATIONS

This application claims the benefit of U.S. Provisional Application No. 61/480,504 filed Apr. 29, 2011.

FIELD OF INVENTION

This invention relates generally to targets for shooting practice, and more particularly to a target that moves as it automatically resets itself.

BACKGROUND

Target practice increases the ability of an individual to use a firearm safely and effectively. Generally target practice is conducted at shooting ranges, which are indoor or outdoor facilities at designated locations that provide a location to shoot safely. Generally shooting ranges also provide one or more stationary targets, which can be set at specific distances from the shooter. Portable targets can be moved manually from position to position. Some targets have multiple subtargets, and may reset themselves to a default starting configuration once all of the subtargets have been shot.

Portable targets known in the art suffer a number of deficiencies. Some existing targets wear quickly when struck by a bullet. This is because, in part, the targets use stiff mechanisms to hold the targets upright while attached to the ground so that there is no give, thus wearing the target and the holding mechanisms. Another disadvantage of known targets is that the devices and holding mechanisms use many components, including springs, locking mechanisms, and releasing mechanisms, that tend to fail or bind during use. Further, the fasteners that attach the targets to the ground damage the surface beneath the device. Another deficiency of known portable targets is that they do not provide for varied shooting directions or distances, because the targets are held stationary while the device is in use. Known portable targets are bulky or awkwardly shaped, making them difficult to transport.

It is an object of this invention to provide a target for shooting practice that is easily portable and that is also durable. It is another object to provide a portable target that moves as it automatically resets itself.

SUMMARY OF THE INVENTION

This invention comprises four paddles emanating from a central point that is substantially equidistant from the end of each of the four paddles. Three of the paddles are configured to be positioned on the ground at any one time in a three-point stance, causing the fourth paddle to be upright and perpendicular to the ground. The upright paddle serves as the target. When a shot hits the device above its center of gravity, the device flips, thus moving away from the shooter. Thus, the device automatically resets itself and moves to a new location, ready for the next hit. Preferably, each paddle is planar from near the central point to the paddle's distal end. Preferably each paddle also has a direction indicator. In a preferred embodiment, each paddle is about 5" long and the target is made of AR400 steel for practice with a 0.22 caliber bullet.

DETAILED DESCRIPTION OF THE INVENTION

In its simplest terms, the device comprises at least four paddles connected at a central point. Conceptually, the preferred embodiment of the device is substantially contained within a polygon, with the distal end of each paddle being at a vertex of the polygon and the central point of the device being at about the central point of the polygon. For the sake of simplicity, throughout this disclosure the device will be discussed as a four-paddle device defining a tetrahedron, but devices of any higher number of paddles and their associated polyhedrons are contemplated by this invention.

Figure 1:
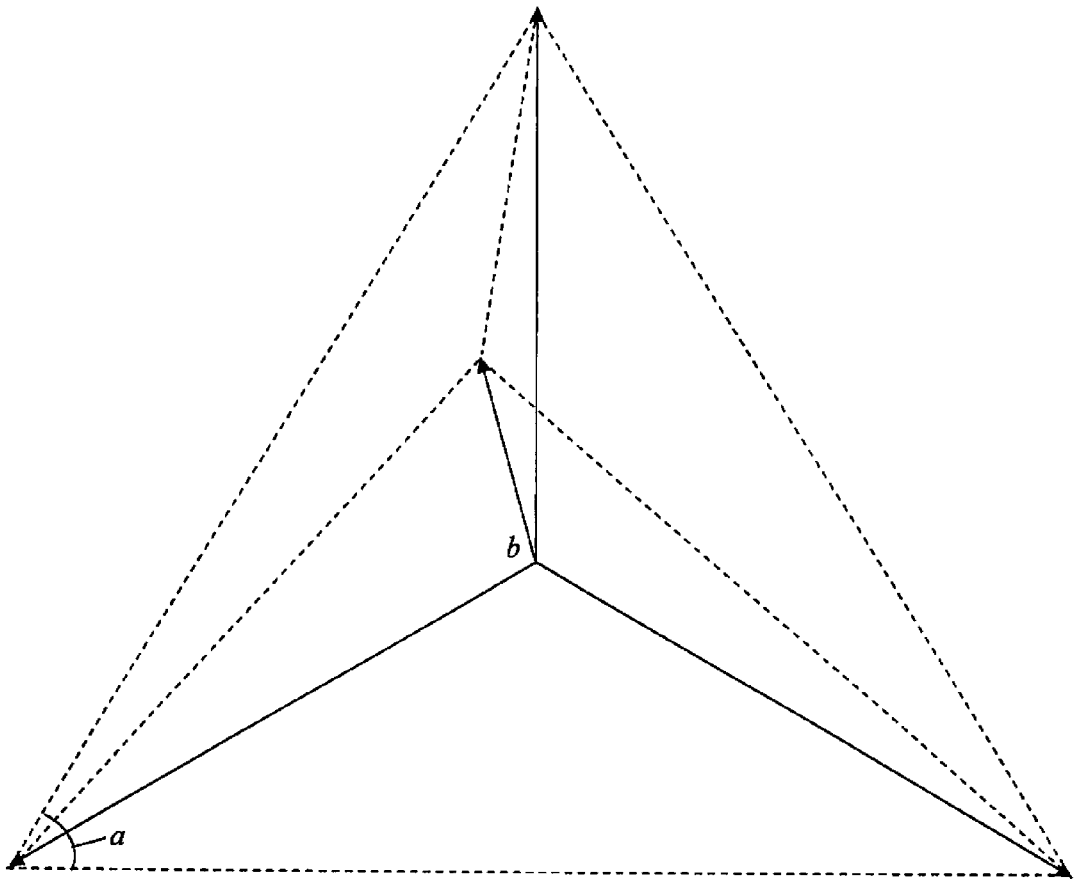
FIG. 1 illustrates the conceptual shape defined by one embodiment of the device.

Conceptually, lines drawn between points on the paddles that are equidistant from a central point define a pyramid, which is a tetrahedron having four triangular faces. See FIG. 1. Preferably each face is substantially the same size and shape as the others. The face resting on the ground is considered the base; the three other faces meet at the apex of the tetrahedron. The inside angle between any two faces, the dihedral angle a, is about 70 degrees. When the tetrahedron is turned so that a face that isn't the base is touching the ground, that face becomes the new base and the other three faces meet at the new apex of the tetrahedron. The tetrahedron has a central point b, equidistant from each of the vertices of the tetrahedron.

FIGS. 2-7 illustrate a device 10 that has a first paddle 11, a second paddle 12, a third paddle 13, and a fourth paddle 14. The paddles 11, 12, 13, 14 are connected together at a central point 15. The paddles are arranged such that when the device 10 is at rest, three of the paddles touch the ground or other substantially horizontal surface and the remaining paddle is upright, substantially perpendicular to the ground. This upright paddle becomes the target 17 for the shooter. For example, in FIG. 2A the second 12, third 13 and fourth 14 paddles rest on the ground and the first paddle 11 is upright and the target 17. In FIG. 2B the first 11, second 12, and fourth 14 paddles rest on the ground and the third paddle 13 is upright and is the target 17. Preferably each paddle has a planar surface that extends substantially from the paddle's proximal end to substantially its distal end. Preferably the planar surface at the end of each paddle connects to the planar surface of the other paddles at the central point. The dimensions of the planar surface are not necessarily uniform along the paddle. Paddles may take on different surface configurations and shapes, as described in more detail below.

In any given resting position, three of the paddles are in contact with the ground and one paddle is raised in the air. Of the three paddles in contact with the ground, at most two of those paddles are located behind the upright paddle, relative to the shooter. Thus, at most two paddles oppose the force of the ammunition transferred to the raised paddle. As used herein, bullet refers to any ammunition, bullet, or other projectile launched at the device 10. The shape, size, weight, and distance between the resting points of each paddle, as well as the material used to make the device 10, will vary depending on the bullet to be used. With the selection of proper parameters for the paddles, the device will flip away from the shooter when the target 17 is hit.

Figure 2A:
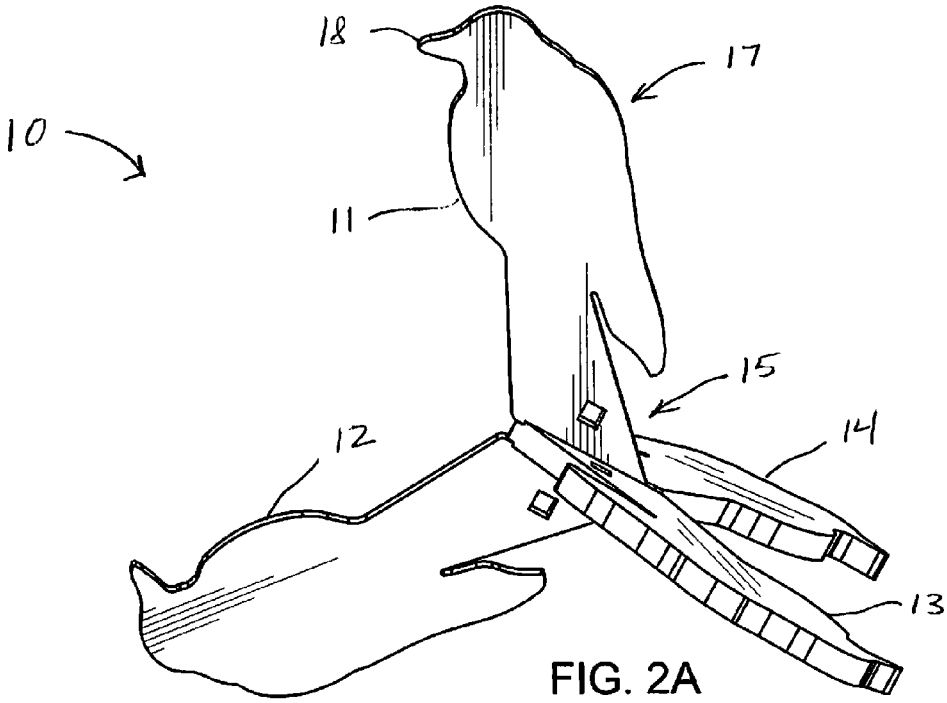
FIG. 2A is a front perspective view of a preferred embodiment of the device showing the direction indicator on the first paddle pointing to left.
Figure 2B:
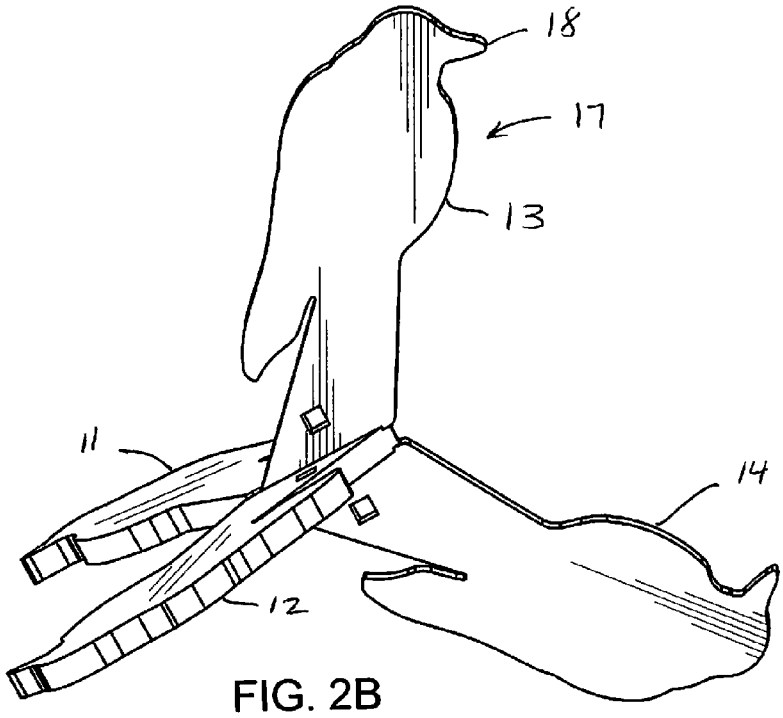
FIG. 2B is a front perspective view of a preferred embodiment of the device in FIG. 2A after flipping once, showing the direction indicator on the third paddle pointing to right.
Figure 3:
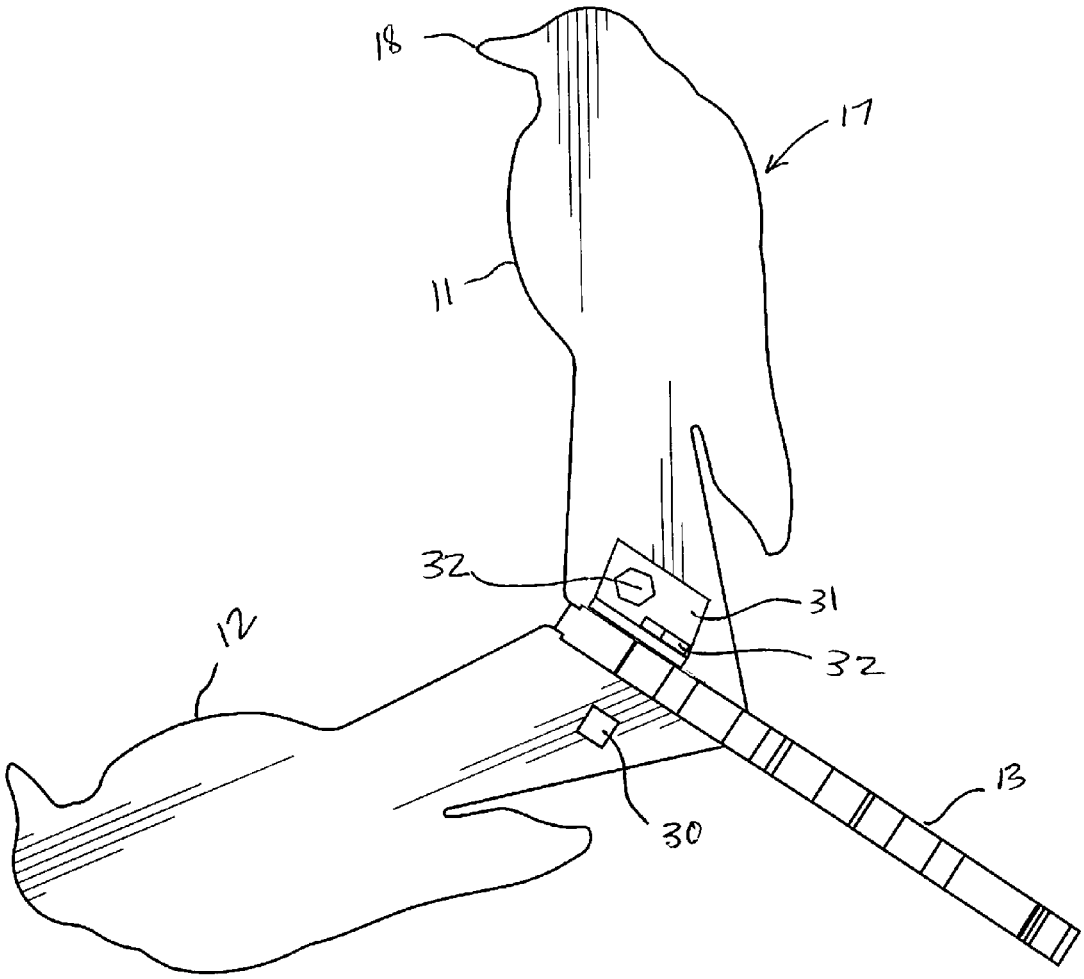
FIG. 3 is an enlarged version of FIG. 2A with an alternative fastening mechanism.
Figure 4:
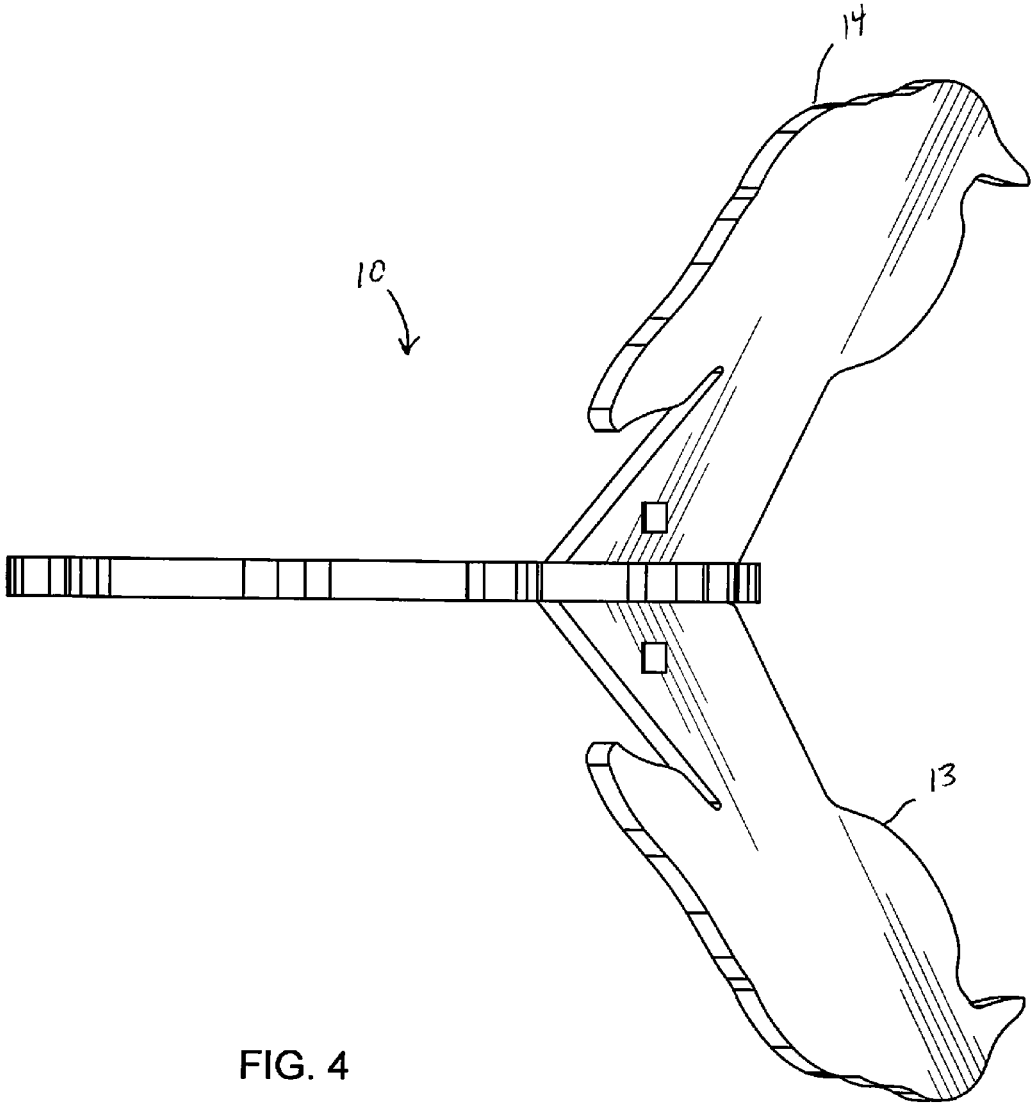
FIG. 4 is a top view of the of a preferred embodiment of the device as shown in FIG. 2A.
Figure 5:
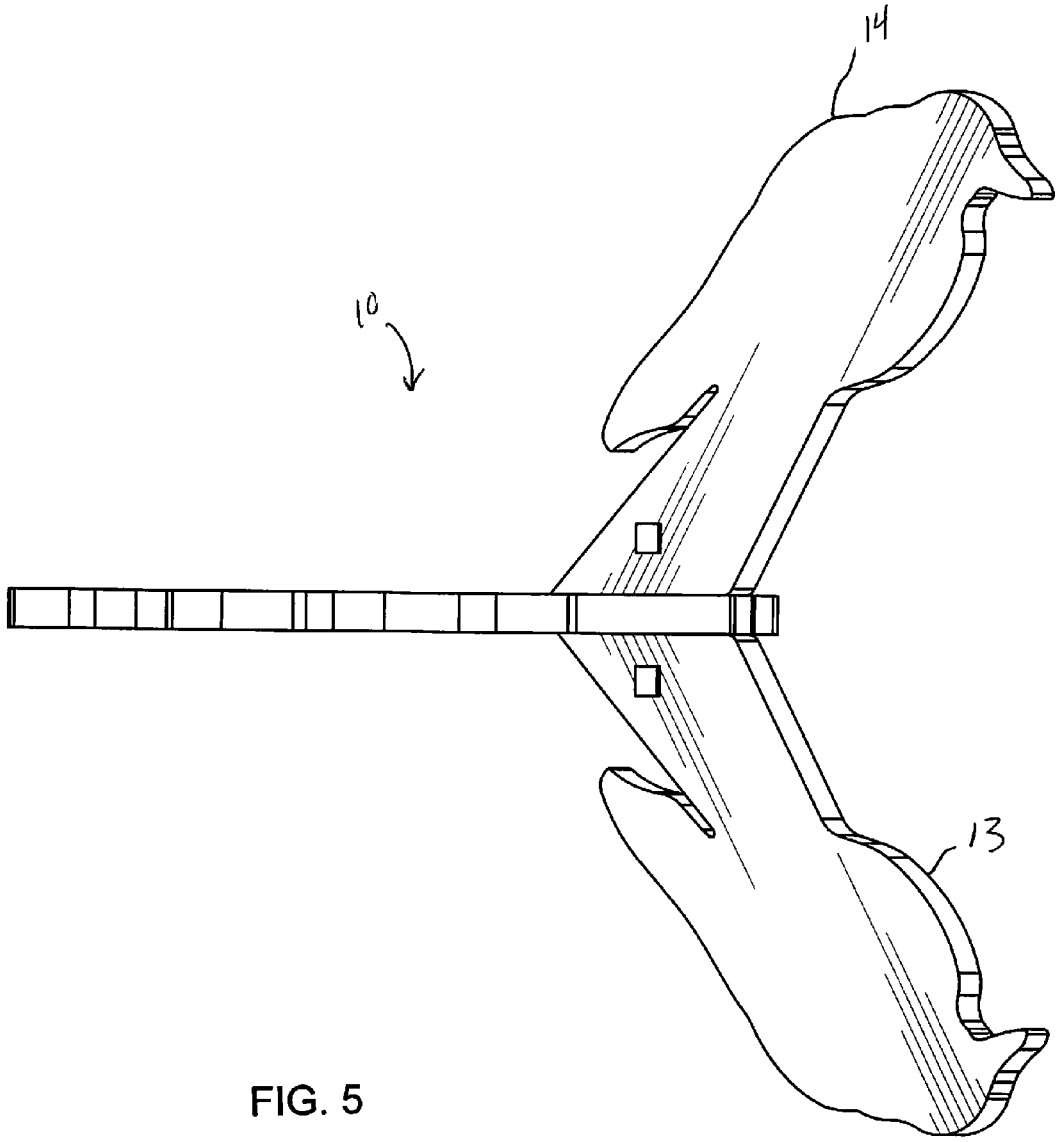
FIG. 5 is a bottom view of the of a preferred embodiment of the device as shown in FIG. 2A.
Figure 6:
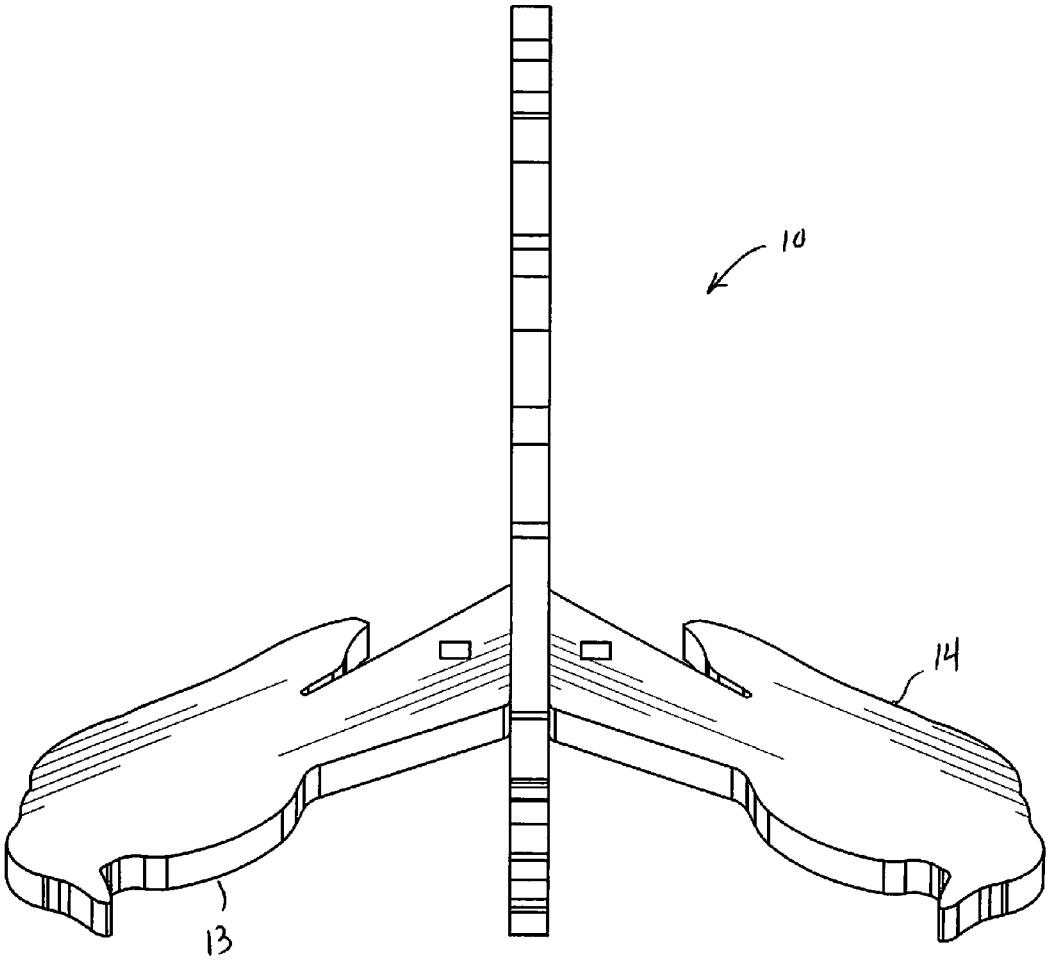
FIG. 6 is a right side view of the of a preferred embodiment of the device as shown in FIG. 2A.
Figure 7:
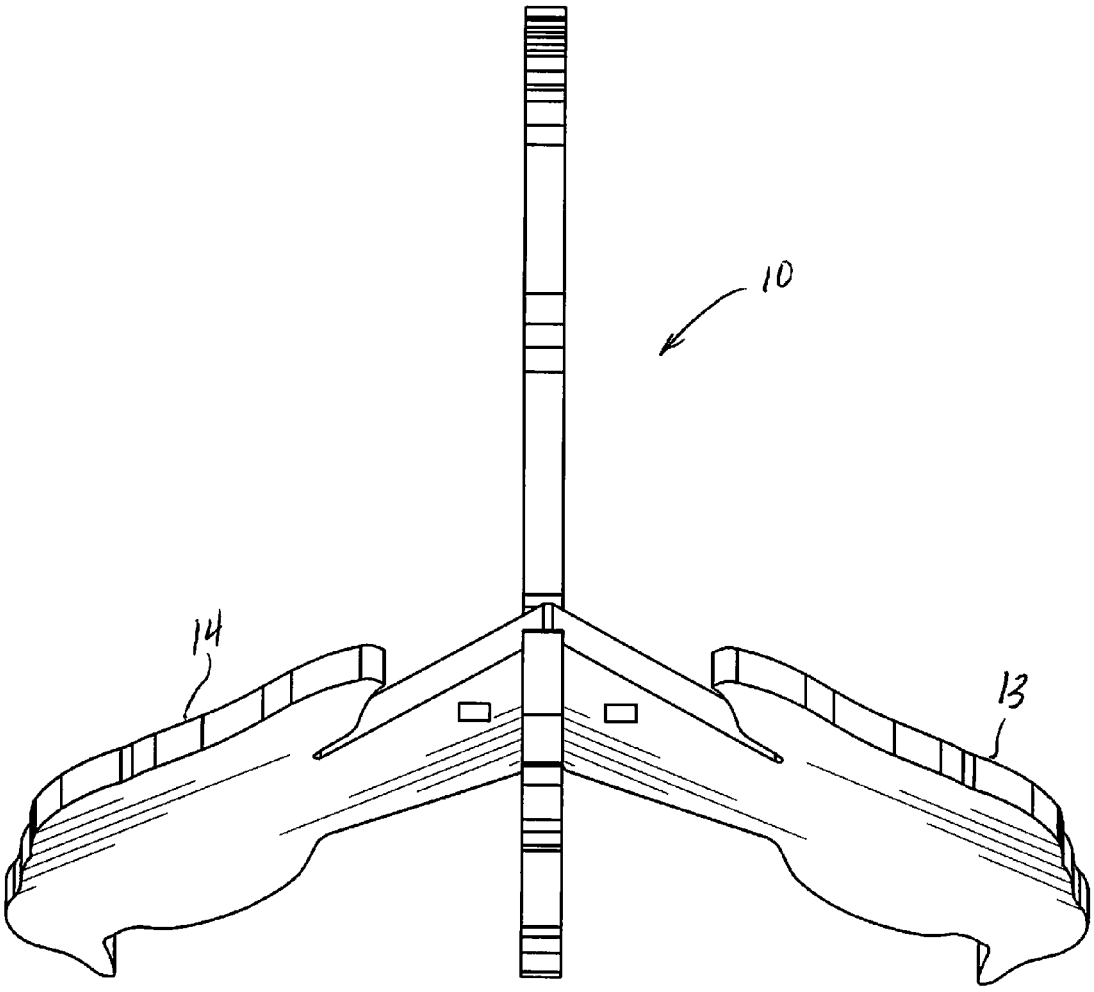
FIG. 7 is a left side view of the of a preferred embodiment of the device as shown in FIG. 2A.

When a bullet hits the device 10 at the target 17, which is above the center of gravity of the device, the horizontal force of the bullet causes the device 10 to rotate, or flip, to a new position instead of being pushed backwards or being pierced by the bullet. When a subsequent shot hits the paddle that is the new target 17 above the center of gravity of the device 10, the device 10 flips again, thus moving away from the shooter. Thus, the device automatically resets itself and moves to a location different than when the shooter fired, ready for the next hit. FIG. 2B shows the device of FIG. 2A after the target is hit. Ammunition that hits the below the center of gravity does not exert sufficient rotating force to flip the target over, so a direct hit to the upright paddle is necessary to do so, thus increasing the accuracy of the shooter. Hitting the device slows the ammunition slightly, and maintains the integrity of the target so that it can be reused and doesn't have to be replaced after each shot.

The shooter can usually determine when it has hit the target because the device flips when it is hit. However, sometimes the flip happens so fast that the shooter may have difficulty determining whether it was hit. Therefore, in a preferred embodiment, each paddle has a direction indicator. For example, in a crow-shaped paddle, the beak can be used as a direction indicator. FIG. 2A shows the beak 18 of the first paddle 11 pointing to left. Upon flipping the target a paddle, such as the third paddle 13, with a right-pointing beak 18 is upright, as shown in FIG. 2B.

In the preferred embodiment, each of the paddles 11, 12, 13, 14 is substantially the same size and shape as the others, as can be seen in FIGS. 4-8, which show the top view, bottom view, right side view, and left side view of the device shown in FIG. 2A. Preferably each paddle is asymmetric along a longitudinal axis. Whether the paddles are symmetric or asymmetric, each paddle is shaped so that when combined with the others, the center of gravity of the device 10 allows the target to rotate when struck with ammunition. When using paddles that are asymmetric around a longitudinal axis, different points along the periphery of the paddle may rest on the ground when the device is in its resting position. For example, as seen in FIGS. 2A and 2B, two of the three paddles on the ground rest on the crow's beak and the third rests on the crow's back. Thus, even though all paddles may be substantially the same length, the distance between the resting points is not necessarily the same.

The device 10 may be constructed as a single piece, for example if molded. Alternatively, the device 10 may be constructed from multiple pieces. For example, four separate paddles can be connected at a central point with fasteners, adhesive or by permanent attachment such as welding. In the preferred embodiment, the device 10 is made from two V-shaped parts 90 which fit together to form a tetrahedron. FIGS. 9-14 show various embodiments of a V-shaped part 90. In the preferred embodiment, each V-shaped part 90 is substantially planar and each leg of each V is a paddle. Preferably each leg of the V is the inverse shape of the other to provide a direction indicator, as described in more detail below, although they may all have the same orientation. In this configuration, the first and second paddles 11, 12 are in one plane and the third and fourth paddles 13, 14 are in a second plane. Preferably each V-shaped part has a slot 91 at its apex for receiving a slot 91 of another V-shaped part, so that the parts are connected at the apexes of the V's. Preferably the V-shaped parts are attached at substantially right angles. Other attachment means may be used. For example, an L-shaped bracket 31 may be used to connect one V-shaped part to another by making holes in the parts and attaching them together with bolts. See FIG. 3. This may be particularly useful for creating target kits, which comprise two V-shaped parts, an L-shaped bracket and bolts to secure the parts together. Because the V-shaped parts are planar, a target kit may have smaller volume than an assembled device, which allows for easier shipment, storage, and display. Preferably the two v-shaped parts 90 in a kit are identical, which makes manufacturing easier.

Figure 8:
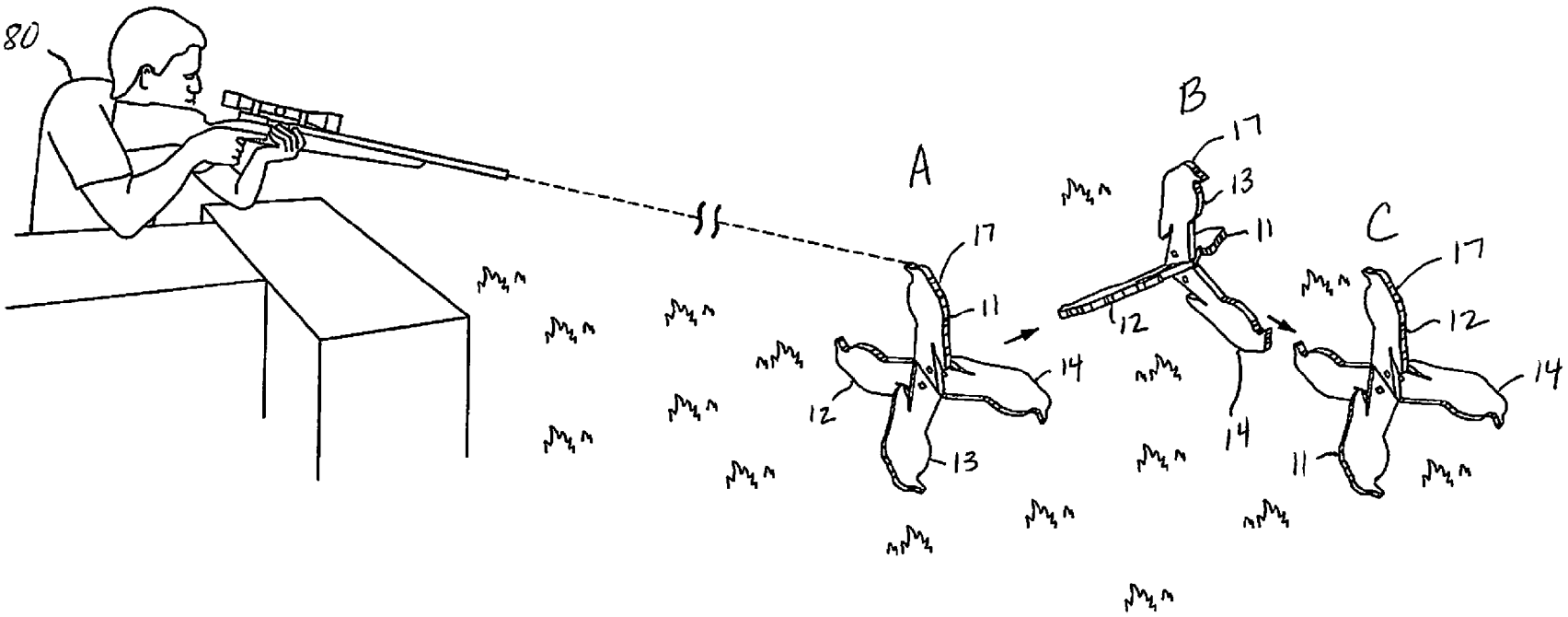
FIG. 8 is a schematic illustration of the device in use for target practice.

FIG. 8 illustrates a time lapse drawing of the device in use. The shooter 80 aims at the device 10 in rest position A in which the first paddle 11 is the target 17. When the bullet hits the first paddle 11, the device 10 flips to rest at position B at which time the third paddle 13 becomes target 17. When the shooter fires another bullet and hits the third paddle 13, the device 10 flips to rest at position C at which time the second paddle 12 becomes target 17. As seen in FIG. 8, the device 10 has reset itself to a different location after each hit. Due to the arrangement of the paddles, even if the surface of the upright paddle is perpendicular to the bullet trajectory, the device will not necessarily flip along the trajectory of the bullet, but at an angle away from it. Thus, not only does the device 10 reset itself to a distance farther away from the shooter, but at a different position side-to-side. FIG. 8 illustrates the resultant zig-zag pattern between rest positions A. B and C. The device 10 will continue flipping and resetting as long as the bullet hits the target 17.

Figure 9:
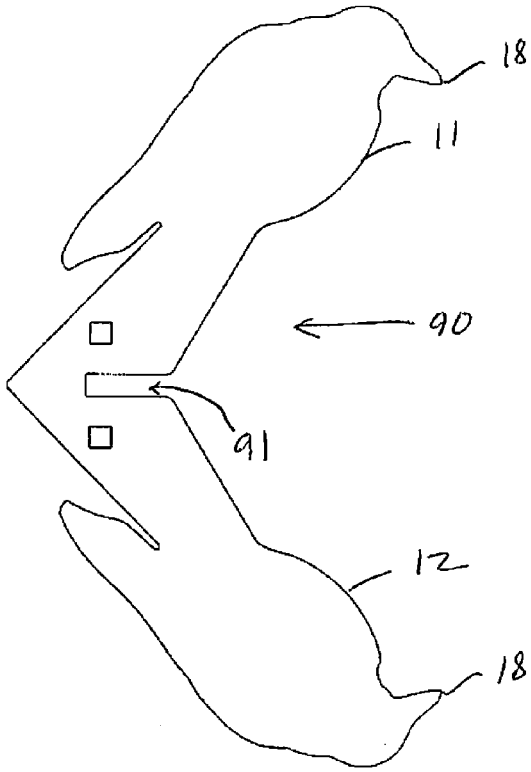
FIG. 9 is a plan view of the crow component.
Figure 10:
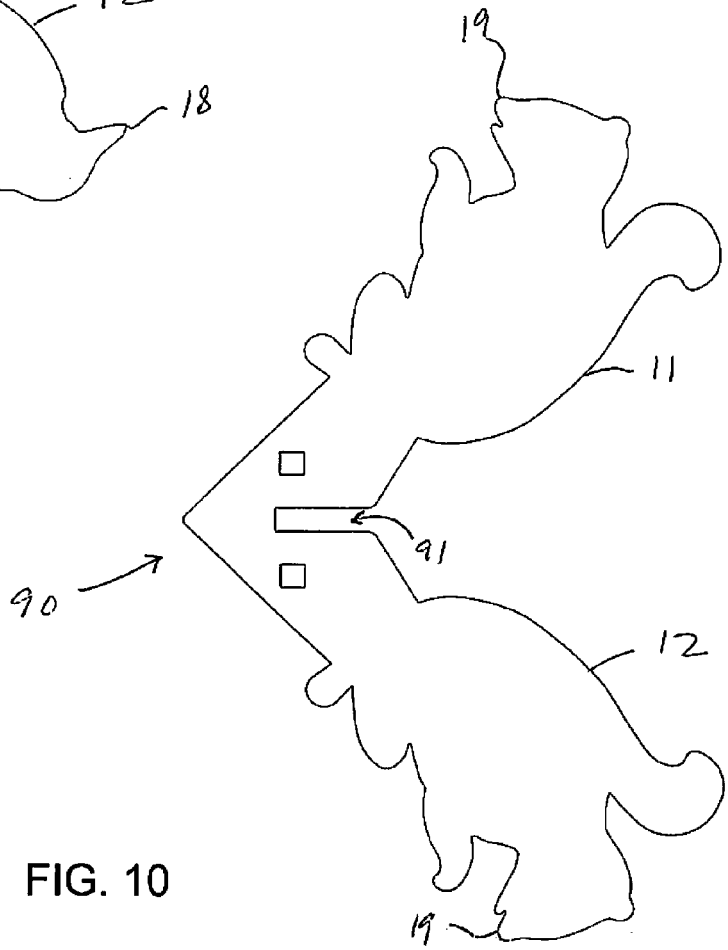
FIG. 10 is a plan view of the squirrel component.
Figure 11:
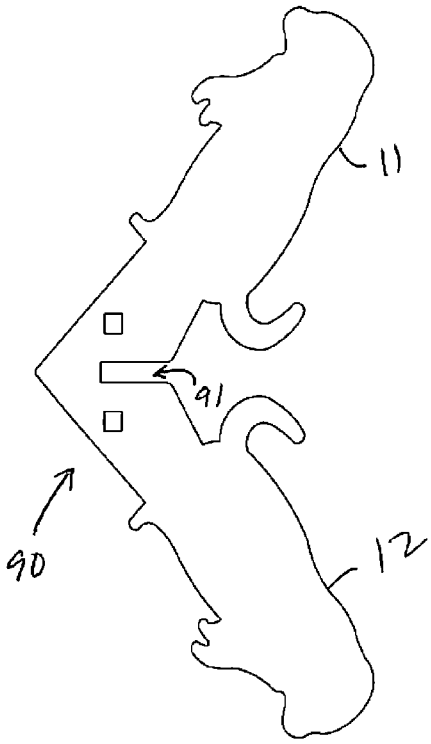
FIG. 11 is a plan view of the prairie dog component.
Figure 12:
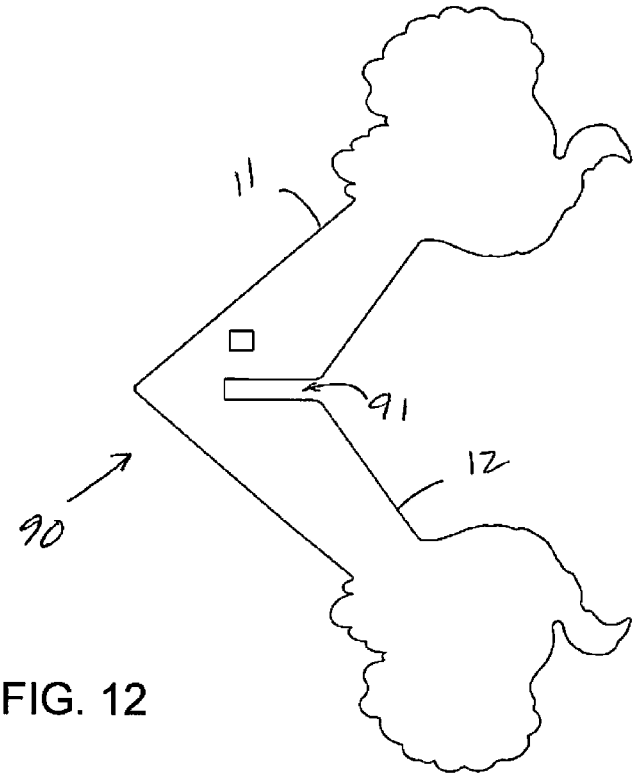
FIG. 12 is a plan view of the turkey component.
Figure 13:
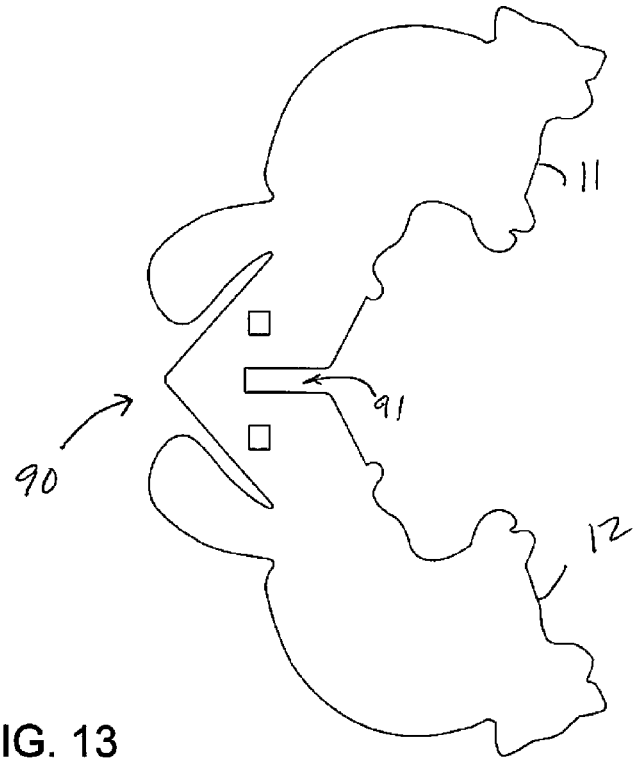
FIG. 13 is a plan view of the raccoon component.
Figure 14:
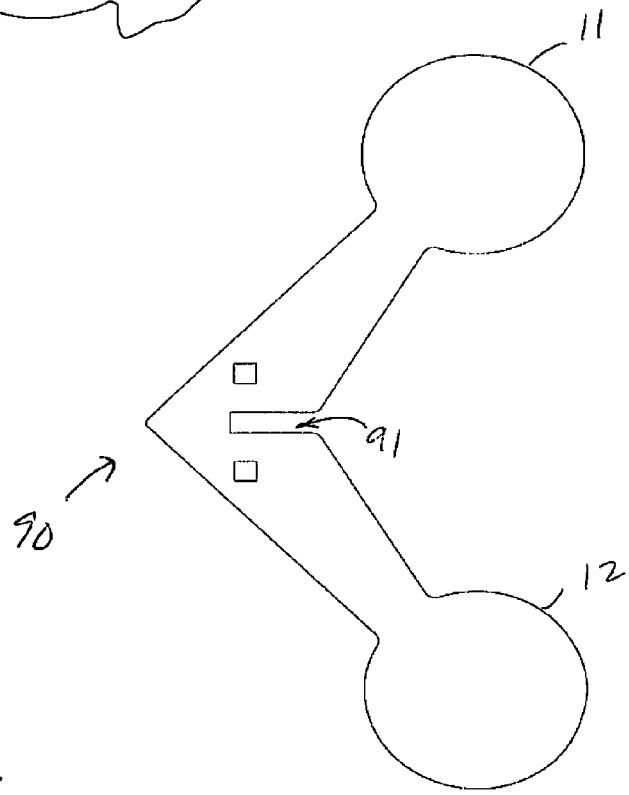
FIG. 14 is a plan view of the circle component.

The paddles can be configured to represent a number of different items, including animals such as deer, bear, wolf, pheasant, etc. FIG. 9 illustrates a V-shaped part 90 in which most of the first paddle 11 is in the shape of a silhouette of a crow with its beak 18 pointing one direction and most of the second paddle 12 is in the shape of a silhouette of a crow with its beak 18 pointing the opposite direction. Similarly, FIG. 10 illustrates a V-shaped part 90 in which most of the first paddle 11 is in the shape of a silhouette of a squirrel with its nose 19 pointing one direction and most of the second paddle 12 is also in the shape of a silhouette of a squirrel with its nose 19 pointing the opposite. FIG. 11 illustrates paddles using a prairie dog in silhouette; FIG. 12 uses a turkey in silhouette at the distal end of the paddles; and FIG. 13 uses a raccoon in silhouette for most of the paddle. Of course, more conventional paddle shapes may be used. FIG. 14 shows paddles having a circular shape at the distal end.

Preferably each paddle has a planar surface that extends from at or near the central point to the paddle's distal end. Paddles can also be rods with two- or three-dimensional targets on the end, but their lack of planar surface means that only the tip of the paddle acts as a target, making it more difficult to hit the device 10 in a way that will flip the device. Thus, the planar surface provides a larger target area than the rods, and may provide for more durability or a better weight: size ratio of the device. Paddles can also be three dimensional, for example if a sphere or set of fins is used at the distal end of each paddle. Paddles may also have undulating or otherwise non-planar surfaces. Although the drawings show the same target shape on each paddle of a given device, a single device may also have two or more paddles having different shapes or sizes.

As mentioned above, it is advantageous to use direction indicators to make it easier to determine whether the device has flipped or not and to determine which paddle is upright. With symmetric geometric shapes such as the circle, square, rectangle, or diamond as the target 17, the periphery of the paddle cannot be used as a direction indicator since there is no visual difference between the sides of a symmetric target. To indicate which paddle is upright, it is preferably to use paddles that are visually asymmetric. In the preferred embodiments, the paddles are silhouettes of animals, which are asymmetric. FIGS. 9-13 illustrate some examples. Instead of asymmetric paddles, or in addition to asymmetry, markings directly on the paddle may suffice as direction indicators. Such markings can be integral with the device, which tend to be more durable, such as etchings, embossments or debossments, or the markings may be on the surface of the device, such as painted or powder coated markings. The paddles may be different colors, or made of different materials, which would also serve as direction indicators. Markings may be used in conjunction with direction indicators based on paddle shape. Indicia that differentiate one paddle from another are referred to herein as direction indicators.

The device 10 is tailored to fit the type of bullet being fired at it. The size, material, and weight chosen will depend on the caliber and type of bullet being used and the weapon is it shot from. The target may be constructed of any material suitable for a target including various metals, plastics, woven materials, and wood. In the preferred embodiment, the paddles are made of abrasion resistant steel such as AR400 or AR500. The type of material chosen will vary depending on what kind of ammunition the device is being made for.

Different sizes of targets can be made for specific ammunition and weapons, which may be valuable for tailoring the targets to skill levels of the shooters. For example, for 0.22 ammunition, a lighter material may be used to create a bigger target that beginner shooters can more easily hit than a heavier, smaller target for more advanced shooters. Accordingly, targets 10 may be caliber specific or caliber-range specific. For example, certain targets 10 may be configured for ".22" ammunition (e.g., .22 long rifle, .22 long, or .22 short ammunition). Other targets 10 may be configured for larger, more powerful ammunition such as 9 mm, .22, .17, 204, 223, 7 mm mag., 300 mag., and 45 pistols, 30-06, 30-30, 40 Smith & Wesson®, .45 ACP, or the like. Targets may be configured for smaller ammunition, such as pellets, bbs, or paint balls. To handle a specific type of ammunition, a target 10 will be of sufficient, but not excessive, weight and have a hardness and strength sufficient to prevent penetration and due to projectile impact.

In a preferred embodiment in which the device is to be used for practice with a 0.22 caliber bullet, each paddle is about 5.5" long, the face dimension is about 8.5" long, the target is made of AR400 steel, and the weight is between about 2.3 lbs and about 3.0 lbs. In another preferred embodiment, in which the device is to be used with 7 mm Remington Magnum rounds, each paddle is about 9.2" long, the face dimension is about 16" long, the target is made of AR500 steel, and the weight is between about 13 lbs and about 15 lbs. For embodiments in which the device is to be used with steel bb's which would ricochet off the paddles, the paddles are made of or covered with force-absorbent or force-spreading material, such as self-healing ballistic plastic, rubber, or synthetic material such as Kevlar®. The devices may be painted for increased visibility and durability or coated with a protective layer for increased safety and durability. In the preferred embodiment an aperture 30 is formed in one or more paddles through which a hook is inserted to hang the device during painting or coating. Alternatively, the aperture can be used to receive fasteners that connect the paddles together.

While there has been illustrated and described what is at present considered to be the preferred embodiment of the present invention, it will be understood by those skilled in the art that various changes and modifications may be made and equivalents may be substituted for elements thereof without departing from the true scope of the invention. Therefore, it is intended that this invention not be limited to the particular embodiment disclosed, but that the invention will include all embodiments falling within the scope of the appended claims.

We claim:

1. A shooting target comprising:

a) a first paddle, a second paddle, a third paddle, and a fourth paddle, wherein:

i. the first and second paddles are in substantially the same plane, connected to each other to form a V-shaped first part, the entirety of the V-shaped first part being planar; and ii. the third and fourth paddles are in substantially the same plane, connected to each other to form a V-shaped second part, the entirety of the V-shaped second part being planar;

b) wherein the first V-shaped part and second V-shaped part are connectable to form a triangular pyramid with the first paddle upright such that when the device is flipped over, the third paddle is upright; and c) wherein the mass of the device is chosen so that the device will rotate and move farther away from a shooter who hits an upright paddle with a bullet of a given caliber.

2. The shooting target of claim 1 wherein:

a) a first direction indicator on the first paddle points in the opposite direction from a second direction indicator on the second paddle; and b) a third direction indicator on the third paddle points in the opposite direction from a fourth direction indicator on the fourth paddle.

* * * * *